United States Patent [19]

Topor

[11] 3,955,715

[45] May 11, 1976

[54] BATH AND SHOWER MODULAR DISPENSER ARRANGEMENT

[76] Inventor: Alan C. Topor, 2100 Jamestown Way, Oxnard, Calif. 93030

[22] Filed: Mar. 13, 1975

[21] Appl. No.: 558,172

[52] U.S. Cl. ..... 222/143; 222/181; 312/111

[51] Int. Cl.[2] ..... B65D 21/02

[58] Field of Search ..... 222/143, 180, 181; 248/205 A; 312/108, 111

[56] References Cited

UNITED STATES PATENTS

| | | | |
|---|---|---|---|
| 2,275,703 | 3/1942 | Trester et al. | 222/181 X |
| 2,950,946 | 8/1960 | Starworth | 312/111 X |
| 3,078,016 | 2/1963 | Judy | 222/181 |
| 3,168,275 | 2/1965 | Grondin | 248/205 A |
| 3,178,061 | 4/1965 | Giacalone et al. | 222/181 X |
| 3,552,817 | 1/1971 | Marcolongo | 312/111 X |
| 3,851,936 | 12/1974 | Muller | 312/108 |

*Primary Examiner*—Robert B. Reeves
*Assistant Examiner*—David A. Scherbel
*Attorney, Agent, or Firm*—Ralph B. Pastoriza

[57] ABSTRACT

Modular containers containing soap, shampoo, or other bath liquids are arranged to be secured to the wall adjacent a bathtub or shower in side-by-side relationship by means of pressure responsive adhesive. Each of the containers includes interlocking structures on left and right side walls so that one or more of the containers can be interlocked together for positioning on the bathroom wall so that one or more different liquids are readily available for convenient use.

3 Claims, 6 Drawing Figures

BATH AND SHOWER MODULAR DISPENSER ARRANGEMENT

This invention relates generally to dispenser containers for bathrooms and more particularly, to an improved modular type container designed such that identically constructed containers may be added to the one container to provide several such containers in side-by-side relationship for easy use.

BACKGROUND OF THE INVENTION

Dispensing containers for holding liquid shampoo, liquid soap, and other liquids used in bathrooms for convenient dispensing of the liquid involved are well known in the art. Some of these containers have been provided with metallic brackets or the like together with suitable screws for securing the container to a bathroom wall. There has not been, to applicant's knowledge, however, a convenient dispensing container arrangement which can be readily affixed to a tile wall, such as the wall adjacent to a bathtub or the wall of a stall shower of such design that securement can be effected without in any way damaging the wall or requiring screwdrivers or the like and also wherein a convenient grouping of the containers together can be accomplished so that several different liquids are readily available from essentially the same area.

BRIEF DESCRIPTION OF THE PRESENT INVENTION

With the foregoing in mind, the present invention contemplates a novel bath and shower modular dispenser arrangement wherein a dispensing container is designed to be easily secured to a bathroom tile wall without the use of auxiliary hardware or screws and further wherein the design of the container is such that one or more additional identically designed containers can be interlocked with the one container so that several such containers can be easily supported in side-by-side relatonship in a single location.

More particularly, in accord with the present invention, a container includes means on one of its wall surfaces for securing it to a tile wall merely by pressing engagement of the container against the wall. In addition, the container includes interengaging means such that an identical additional container can have a portion of its interengaging means interengaged with another portion of the first-mentioned interengaging means to support the additional container adjacent to the first-mentioned container so that two different liquids may be made conveniently available.

Because of the modular design of each container, more than two such containers may be interlocked in side-by-side relationship if desired.

BRIEF DESCRIPTION OF THE DRAWINGS

A better understanding of the invention will be had by referring to a preferred embodiment thereof as illustrated in the accompanying drawings in which.

DETAILED DESCRIPTION OF THE PREFERRED EMBODIMENT

Figure 1:
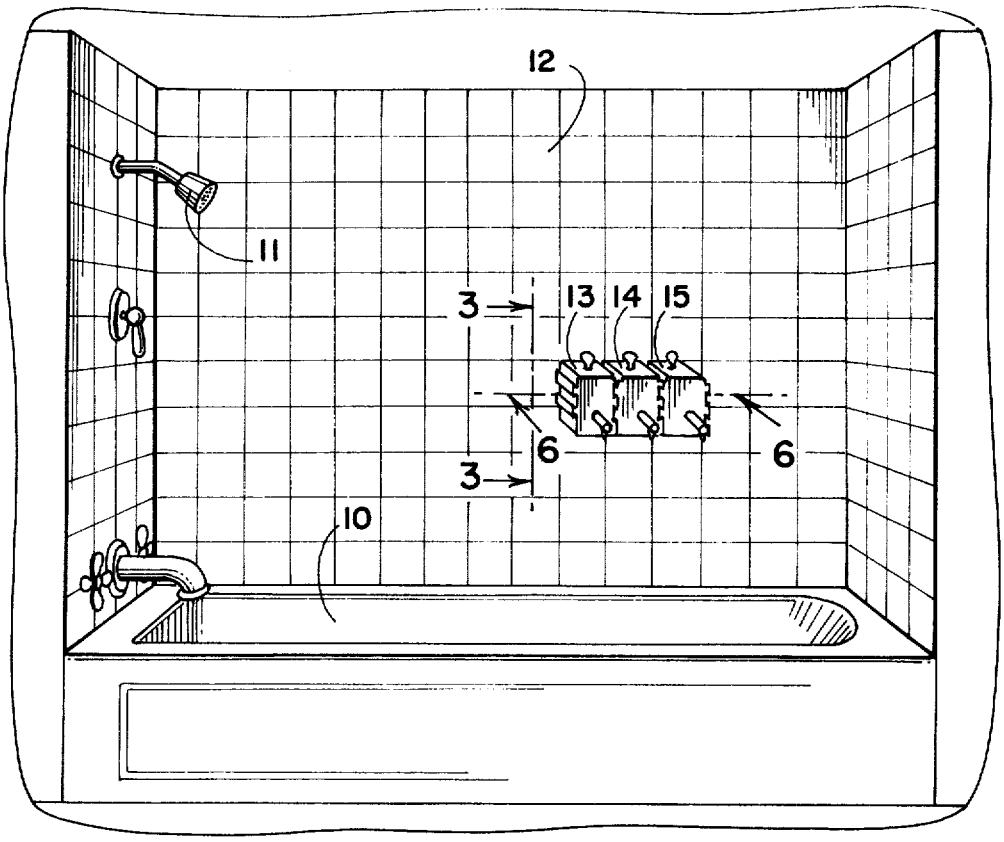
FIG. 1 is a front perspective view of a typical bathtub-shower combination wherein a common tile wall has secured to its surface in a desired location the modular dispenser arrangement of this invention.

Referring first to FIG. 1, there is shown a portion of a typical bathroom including a bathtub 10 and associated shower 11. High tiled walls are normally provided for the shower 11 such as indicated at 12 and in accord with the present invention, one or more dispensing containers 13, 14 and 15, each identically constructed, may be affixed in side-by-side relationship to the wall 12 in a convenient position.

It will be understood, of course, that the dispensing containers could be secured to any one of the walls in a typical stall shower or, alternatively, to a tiled wall portion or other wall portion surrounding a bathtub. Normally, the containers would be filled with liquid soap, shampoo, hair rinse, or other liquids used in the bathroom.

Figure 2:
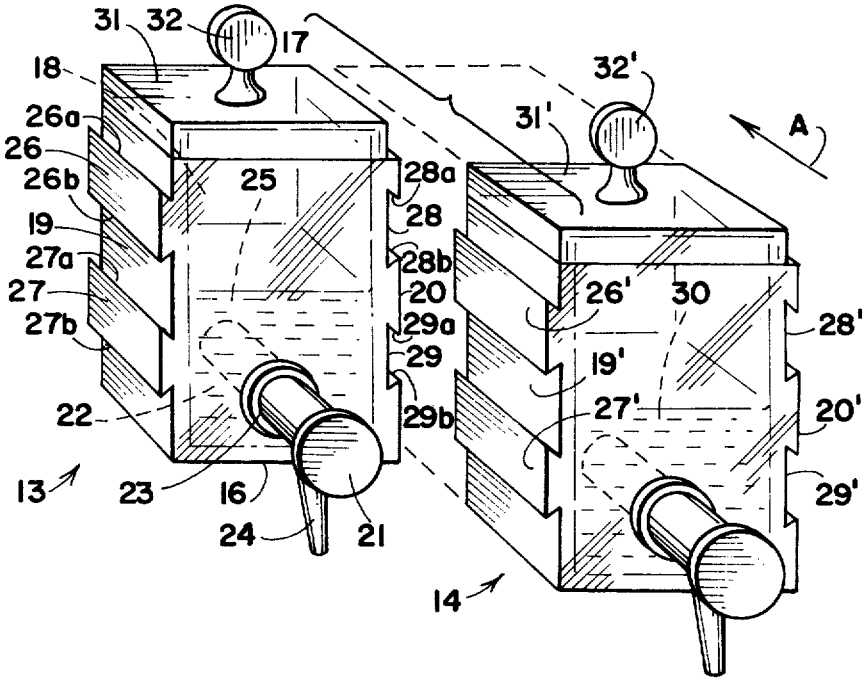
FIG. 2 is an enlarged perspective exploded view of two of the containers in separated position preparatory to being interlocked together in side-by-side relationship.

Referring now to FIG. 2, details of the dispensing container will be described. Considering, by way of example, the dispensing container 13, this container has a closed bottom 16 and front, rear, left and right side walls 17, 18, 19 and 20, respectively. In the embodiment illustrated, the material for the container constitutes a transparent or translucent plastic, but any other suitable material may be used.

A manually operable liquid dispenser 21 has an interior portion 22 within the container adjacent to the bottom 16, the dispenser passing through the front wall 17 as at 23 and including an outlet spout 24. This dispensing structure is identical on all three of the dispensers 13, 14 and 15 illustrated in FIG. 1 and is of a well known design, liquid in the container being pumped by simply pressing on the manually operable portion 21.

In FIG. 2, there is shown a liquid 25 within the container 13 which, by way of example, may constitute shampoo.

In accord with an important feature of this invention, the container is provided with interengaging means including first and second portions on the left and right side walls respectively. Thus, the first portion of the interengaging means on the left wall 19 takes the form of at least one and preferably two projecting strips 26 and 27 running horizontally from the front to the rear of the side wall and having under cut upper and lower edges as at **26*a* and 26*b* for the strip 26 and 27*a* and 27*b* for the strip 27**.

The second portion of the interengaging means on the right side wall 29 comprises at least one and preferably two elongated channels 28 and 29 running horizontally from the front to the rear of the right side wall and having under cut upper and lower edges **28*a* and 28*b* for the channel 28 and 29*a* and 29*b* for the channel 29**.

In the preferred embodiment, the dispensing container 13 is completed by the provision of a top cover 31 which may be provided, if desired, with a handle 32 for facilitating removal.

With the foregoing arrangement, it will be evident that an identical additional dispensing container such as the container 14 shown in exploded view in FIG. 2 can be interengaged with the first-mentioned container 13. Thus, the additional container 14 includes identical interengaging means, the first portion on the left side wall being indicated by the same numerals followed by a prime and the second portion in the form of the channels on the right side wall similarly being indicated by the same numerals followed by a prime.

To interfit the containers together, the rear end of the left side wall 19' of the additional container 14 is positioned adjacent to the front end of the right side wall 20 of the first container 13 and the additional container then slid in a horizontal direction towards the rear as indicated by the arrow A, the strips 26' and 27' on the additional container 14 being received in the channels 28 and 29 on the container 13.

It will be evident from the foregoing that further additional containers can be serially added on to the additional container 14 such as the container 15 described in FIG. 1.

Figure 3:
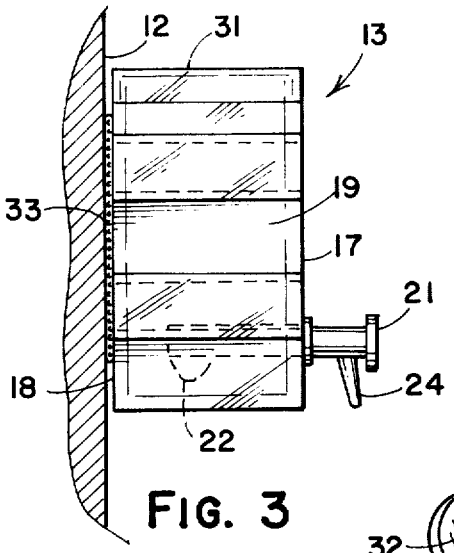
FIG. 3 is a side elevational view of one of the dispensers of the FIG. 1 looking in the direction of the arrows 3—3.

Referring now to FIG. 3, the rear wall 18 of the container 13 is provided with a pressure responsive adhesive means in the form of an adhesive strip 33. It will be appreciated that with such a pressure responsive adhesive strip, to secure the container to the tile wall 12 it is only necessary to push the container against the wall. Since a pushing in a horizontal direction against the wall is necessary to secure the container, the interengaging means for securing an additional container adjacent to the first container must necessarily operate in such a manner that the additional container moves in a horizontal direction towards the wall when it is being intercoupled with the first container. By this arrangement, the corresponding adhesive means on the rear wall of the additional container will simply be pressed into engagement with the wall 12 so that both containers are secured in side-by-side relationship. Any other type of interlocking means wherein a motion other than horizontal in a direction towards the rear wall could not feasibly be used as otherwise the adhesive material on the additional container could not be properly pressed against the wall in a direction normal to the wall.

Figure 4:
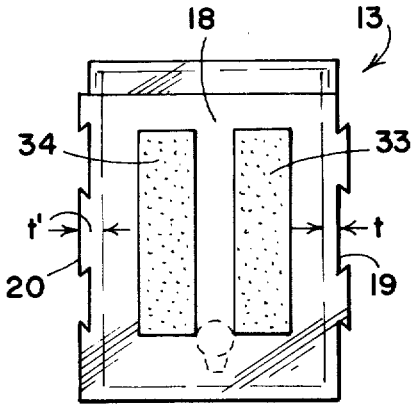
FIG. 4 is a rear elevational view of the dispenser.

FIG. 4 illustrates in rear elevational view the rear wall 18 of the container 13 wherein in the preferred embodiment there is provided an additional adhesive strip shown at 34. It will also be noted in FIG. 4 that the right side wall 20 (which appears on the left in the rear view of FIG. 4) is thicker than the left side wall 19. The purpose for this increased thickness of the one side wall will become clearer as the description proceeds.

Figure 5:
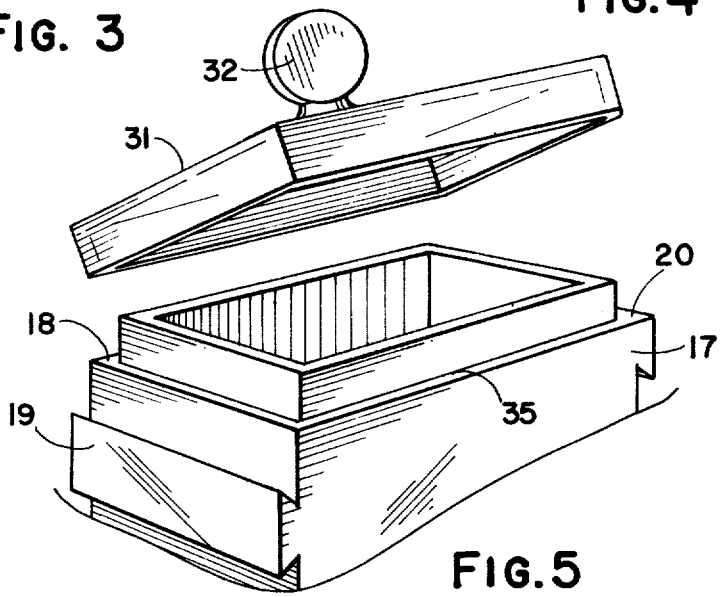
FIG. 5 is a fragmentary perspective view of the upper end portion of a dispenser showing a cover in exploded position; and, FIG. 6 is a cross section of a plurality of the dispenser units taken in the direction of the arrows 6—6 of FIG. 1.

Referring now to the enlarged fragmentary view of FIG. 5, it will be noted that the upper outside wall portions of the front, rear, left and right side walls 17, 18, 19 and 20 respectively, are of less thickness than the remaining portions to define an annular ledge 35 about the top portions of the container. The cover 31 shown in exploded view above the container in FIG. 5 is dimensioned to fit over this ledge 35 so that the front, rear and left side walls of the cover are flush with the front, rear and left walls of the container. The right side wall of the cover 31 will not be flush with the right side wall 20 of the container because of the greater thickness of this side wall as described in FIG. 4.

Figure 6:
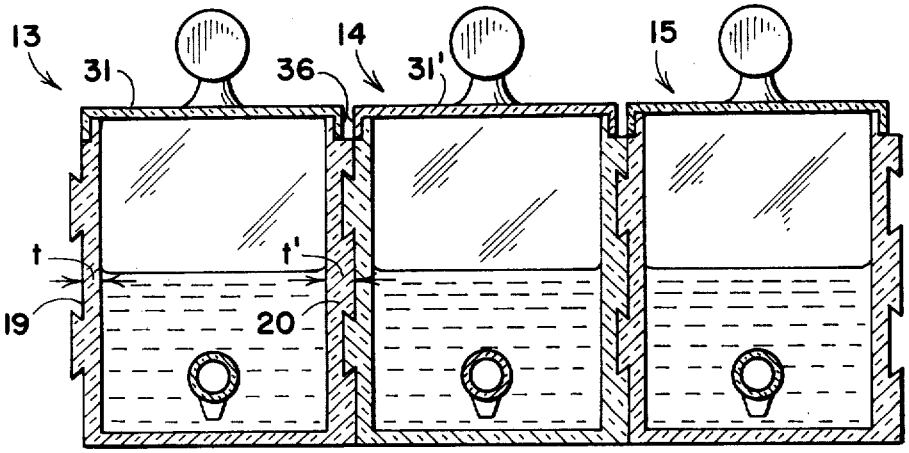

Referring now to the cross section of FIG. 6, the several containers 13, 14 and 15 described in FIG. 1 are shown in their interlocked positions wherein the manner in which the projecting strip portions fit within the channels will be clear. Also, it will be clear that because of the thicker right side wall 20 as indicated at *t'* relative to the left side wall 19 indicated at t, there will be a slight space as indicated at 36 between the adjacent covers 31, 31' and so forth, of the containers. This spacing is exaggerated somewhat in size for purposes of clarity. The purpose for providing the slight spacing is to assure that each of the covers can easily be removed without one rubbing against the other.

With respect to the foregoing, it will also be appreciated that the adhesive strips described in FIG. 4 have a finite thickness which will hold the rear wall 18 of each of the containers spaced slightly from the tile wall of the bathroom so that again the covers may be easily removed without rubbing engagement with this tile wall.

OPERATION

The operation of the modular dispenser arrangement will be evident from the foregoing description. Depending upon the number of liquids it is desired to have available in a convenient location in the bathroom, a corresponding number of containers will be provided and interlocked together as described. As a practical matter, a person may start out with only a single container which he can readily affix to the tile wall of the bathroom for holding, for example, liquid soap. Thereafter, if a special shampoo is found to be useful, a second additional identical container can be filled with the shampoo and then readily interlocked in position against the same tile wall with the first container in side-by-side relationship. Further containers can be added.

Because of the interengaging structure as described, it will be evident that the addition of further containers can be effected without having to remove the first fixed container, the additional containers not only being secured in place as a consequence of the interengagement with each other but also as a result of the pressure responsive adhesive on the rear walls of these additional containers.

The various containers can be periodically filled by simply removing the top covers and pouring in the desired liquid to be dispensed.

From the foregoing description, it will be evident that the present invention has provided a convenient bath and shower modular dispenser arrangement wherein it is not necessary to use special tools or in any way damage a tile wall to which the container or containers are to be affixed. Further, the modular arrangement enables several such containers to be neatly and attractively positioned in secure side-by-side relationship with the end beneficial result of providing several different liquids readily available for convenient use by a bather.

What is claimed is:

1. A bath and shower modular dispenser arrangement comprising, in combination:

a. a container having a closed bottom and front, rear, left and right side walls;

b. a manually operable liquid dispenser extending from the interior of the container for dispensing liquid when said container is filled with liquid;

c. holding means on said rear wall for securing said rear wall against a vertical surface adjacent to a bath or shower when pressed thereagainst;

d. interengaging means comprising first and second portions on the left and right side walls respectively, such that the first portion on the left wall of an identical additional container may be interfitted with the second portion on the right wall of said first-mentioned container by positioning the rear of the left wall of the additional container adjacent to the front of the right wall of the first-mentioned container and sliding the additional container in a rearward horizontal direction so that the additional container is secured in side-by-side relationship with the first-mentioned container, the upper outside wall portion of the front, rear, left and right side walls being of less thickness than the remaining portions to define an annular ledge about the top of the container; and, e. a cover for the container dimensioned to fit over said ledge so that its front, rear and left sides are flush with the remaining portion of the front, rear and left side walls of the container, the right side wall of the container being thicker than the remaining walls so that a space is left between the covers on the adjacent containers resulting from the interlocking of said additional container to said first-mentioned container.

2. The subject matter of claim 1, in which said holding means comprises a pressure responsive adhesive.

3. The subject matter of claim 1, in which the first interengaging portion includes at least one projecting strip running horizontally from the front to the rear of said left side wall and having undercut upper and lower edges, the second interengaging portion including at least one elongated channel running horizontally from the front to the rear of said right side wall and having undercut upper and lower edges dimensioned to receive the strip on the additional container in interlocking relationship.

* * * * *